US008915771B2

(12) United States Patent
Vogtmann

(10) Patent No.: US 8,915,771 B2
(45) Date of Patent: Dec. 23, 2014

(54) METHOD AND APPARATUS FOR CLEANING GRINDING WORK CHUCK USING A VACUUM

(71) Applicant: Michael Vogtmann, Paso Robles, CA (US)

(72) Inventor: Michael Vogtmann, Paso Robles, CA (US)

(73) Assignee: Strasbaugh, Inc., San Luis Obispo, CA (US)

( * ) Notice: Subject to any disclaimer, the term of this patent is extended or adjusted under 35 U.S.C. 154(b) by 109 days.

(21) Appl. No.: 13/694,723

(22) Filed: Dec. 27, 2012

(65) Prior Publication Data

US 2014/0187128 A1 Jul. 3, 2014

(51) Int. Cl.

| | |
|---|---|
| ***B24B 55/06*** | (2006.01) |
| ***B24B 7/22*** | (2006.01) |
| ***B24B 9/06*** | (2006.01) |

(52) U.S. Cl.

CPC ..... *B24B 55/06* (2013.01); *B24B 7/228* (2013.01); *B24B 9/065* (2013.01)

USPC ..... 451/456; 451/73

(58) Field of Classification Search

CPC ..... B24B 55/06; B24B 1/00

USPC ..... 451/456, 453, 41, 388, 73

See application file for complete search history.

(56) References Cited

U.S. PATENT DOCUMENTS

| | | | | |
|---|---|---|---|---|
| 5,603,775 | A * | 2/1997 | Sjoberg | 134/21 |
| 6,176,770 | B1 * | 1/2001 | Kao et al. | 451/456 |
| 6,682,406 | B2 * | 1/2004 | Chiou | 451/56 |
| 7,118,446 | B2 * | 10/2006 | Walsh et al. | 451/5 |
| 7,458,878 | B2 * | 12/2008 | Walsh et al. | 451/5 |
| 8,308,469 | B2 * | 11/2012 | Koizumi et al. | 425/229 |

* cited by examiner

*Primary Examiner* — Robert Rose

(74) *Attorney, Agent, or Firm* — Irving Keschner

(57) ABSTRACT

A vacuum assembly for removing debris formed on the surface of a work chuck after a wafer grinding process by positioning a vacuum source above the work chuck and then activating the vacuum source.

9 Claims, 6 Drawing Sheets

METHOD AND APPARATUS FOR CLEANING GRINDING WORK CHUCK USING A VACUUM

BACKGROUND OF THE INVENTION

1. Field of the Invention

The present invention relates to a method and apparatus for cleaning the porous ceramic grind chuck used in semiconductor wafer grinding machines.

2. Background of the Invention

U.S. Pat. No. 7,118,446, issued to Thomas A. Walsh and Salman Kassir and assigned to the assignee of the present invention exemplifies the status of prior art grinder apparatus technology. A chuck is provided in the apparatus to hold a work piece, such as a wafer, in place so that the work piece does not slip or otherwise move while being shaped by a grind wheel.

The chuck is porous i.e. holes are drilled therethrough it or otherwise comprises a porous material; a partial vacuum being provided below the chuck to hold the work piece in place. Coolant is pumped directly onto an area of contact between a grind wheel and the workpiece surface, providing cooling and cleaning of grind debris (swarf) from the surface of the workpiece.

During the grinding process, vacuum is applied through the porous portion of the work chuck to hold the wafer. Due to dimensional differences between the wafer and the porous portion of the work chuck, there can be a small section near the periphery of the porous portion that is exposed to the grinding swarf. The porous portion of the work chuck will "suck-up" the small particles in the grind swarf. Over time, the small particles from the grind swarf will clog the porous material closest to the perimeter of the wafer. The porous material may get clogged with small particles below the wafer surface. If the wafer edge is not pulled down to the work chuck, the edge of the wafer will rise during the grinding process removing too much material at the edge of the wafer. The clogging of the work chuck edge reduces the life of the work chuck due to the over grinding of the wafer edge.

What is thus desired is to provide a work chuck cleaning procedure wherein the cleaning can be done either automatically or manually.

SUMMARY OF THE INVENTION

The present invention provides method and apparatus for cleaning the surface of a chuck used to hold a workpiece, such as a wafer, in position during grinding and assisting in the removal of small particles in the work chuck allowing vacuum to flow again, the process being accomplished manually or automatically. In particular, a vacuum cleaner assembly is positioned within a wafer grinder apparatus adjacent the edge of the work chuck. The assembly comprises a vacuum device for pulling particles, or swarf, from the top surface of the chuck. The assembly further comprises a fluid source which, when activated, directs fluid to the chuck surface which in turn causes the assembly to hover above the work chuck surface. The vacuum source is then activated to remove particles from the chuck surface. A source of sonic energy may be positioned in the fluid path, the sonic energy loosening particles that may be tightly adhering to the chuck surface.

DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

Figure 1A:
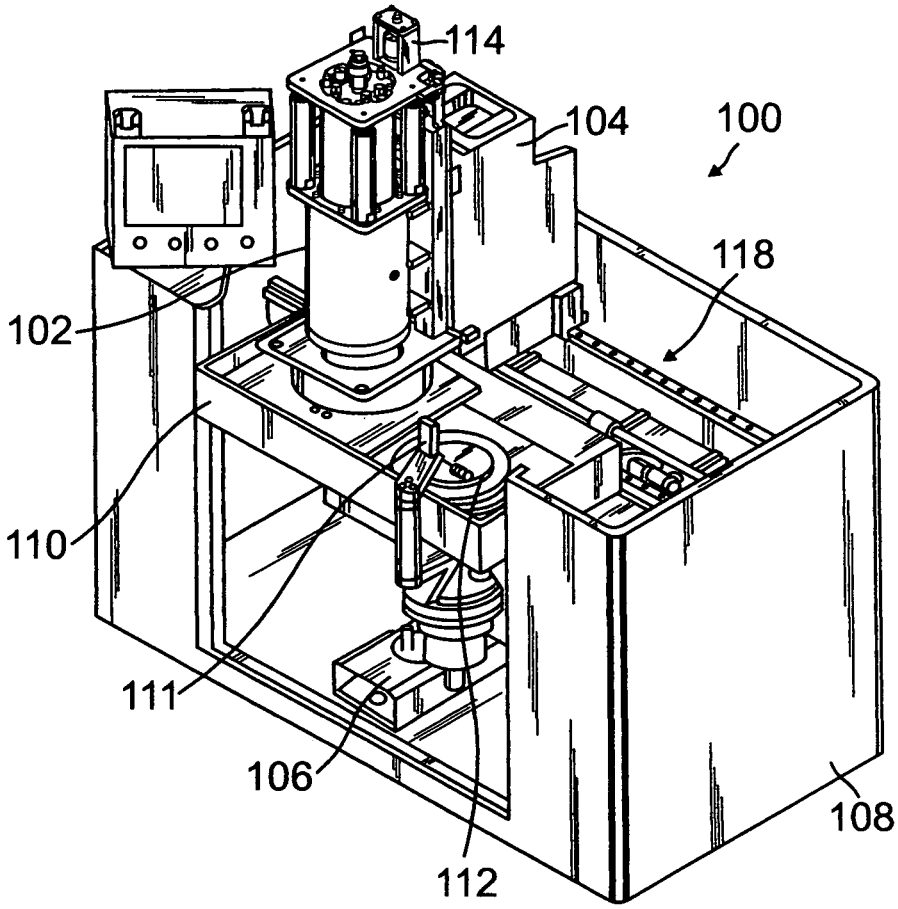
FIG. 1A PRIOR ART
FIGS. 1A and 1B are perspective and plan views, respectively, of a prior art grind apparatus assembly modified to incorporate the vacuum cleaning system of the present invention.
Figure 1B:
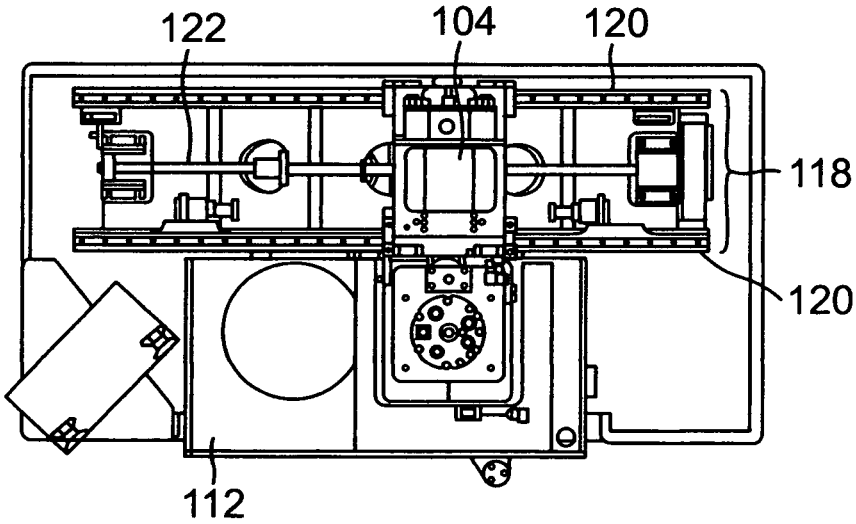
FIG. 1B PRIOR ART

In order to put the present invention in proper perspective, FIGS. 1A and 1B illustrate a prior art grinder assembly, such as that disclosed in the '446 patent, modified to incorporate the cleaner assembly of the present invention.

Referring to FIGS. 1A and 1B, shown are perspective and plan views respectively of the compact grinder assembly 100 disclosed in the '446 patent. Shown is a grind spindle 102, a spindle support column 104, a work spindle 106, a cabinet 108, a splash pan 110, a chuck 112, a thickness probe 111, a ball screw assembly 114, a bed portion 118, rails 120 and a ball screw 122.

The grind spindle 102 is coupled with the spindle support column 104, and the spindle support column 104 is engaged with the rails 120 and the ball screw 122. The cabinet 108 supports the rails 120, ballscrew 122, the work spindle 106 and the splash pan 110. The thickness probe 111 is coupled with the work spindle 106 and is shown positioned above the chuck 112.

The grind spindle 102 is moved along a vertical axis by the ball screw assembly 114 and includes at least one grind wheel (not shown) in order to shape a work piece, for example, semiconductor wafers.

The chuck 112 holds the work piece in place so that the work piece does not slip or otherwise move while being shaped by a grind wheel on the grind spindle 102. For example, the chuck 112 is porous, e.g. it has holes drilled through it or otherwise comprises a porous material, and a partial vacuum is provided by a device (not shown) positioned below the chuck 112 to hold the work piece in place.

The spindle support column 104, supports the grind spindle 102, and is moveably engaged with the support column 104, and hence the grind spindle 102, to translate back and forth in a horizontal direction. Specifically, the spindle support column 104, and the grind spindle 102 move with respect to the cabinet 108, the work spindle 106, and thus a surface of a rotatable work piece mounted on the chuck 112.

The ability to translate the grinding assembly 104 allows shaping of a work piece to be achieved on both a face and an edge of the work piece with a single machine. Specifically, a grinding wheel of the grind spindle 102 is first positioned over an edge of the work piece and then moved into contact with the edge of the work piece until the edge is shaped as desired.

The grind spindle 102 is then raised vertically above the work piece, translated horizontally over a face of the work piece so the grinding wheel is positioned over the face of the work piece, and then the grinding wheel is then placed in contact with the face of the work piece by lowering the grind spindle 102 until the grinding wheel is in contact with a portion of the face of the work piece.

Figure 2:
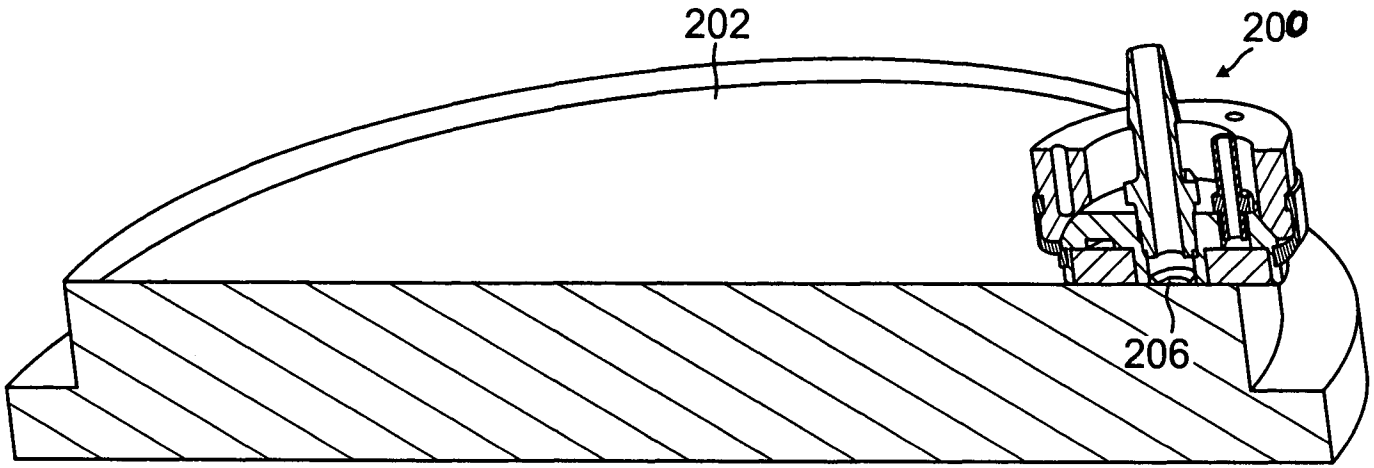
FIG. 2 is a partial perspective view illustrating where the vacuum cleaner of the present invention is positioned relative to the work chuck.

Referring to FIG. 2, the work chuck vacuum cleaner assembly 200 of the present invention is positioned above the top surface 202 of work chuck 204 and adjacent the edge 206 thereof. The backflush operation that is part of the process disclosed in the '446 patent cooperatively operates with the assembly 200, the former forcing trapped particles from near the bottom of the work chuck whereas assembly 200 removes trapped particles from the top surface of the work chuck.

Figure 3:
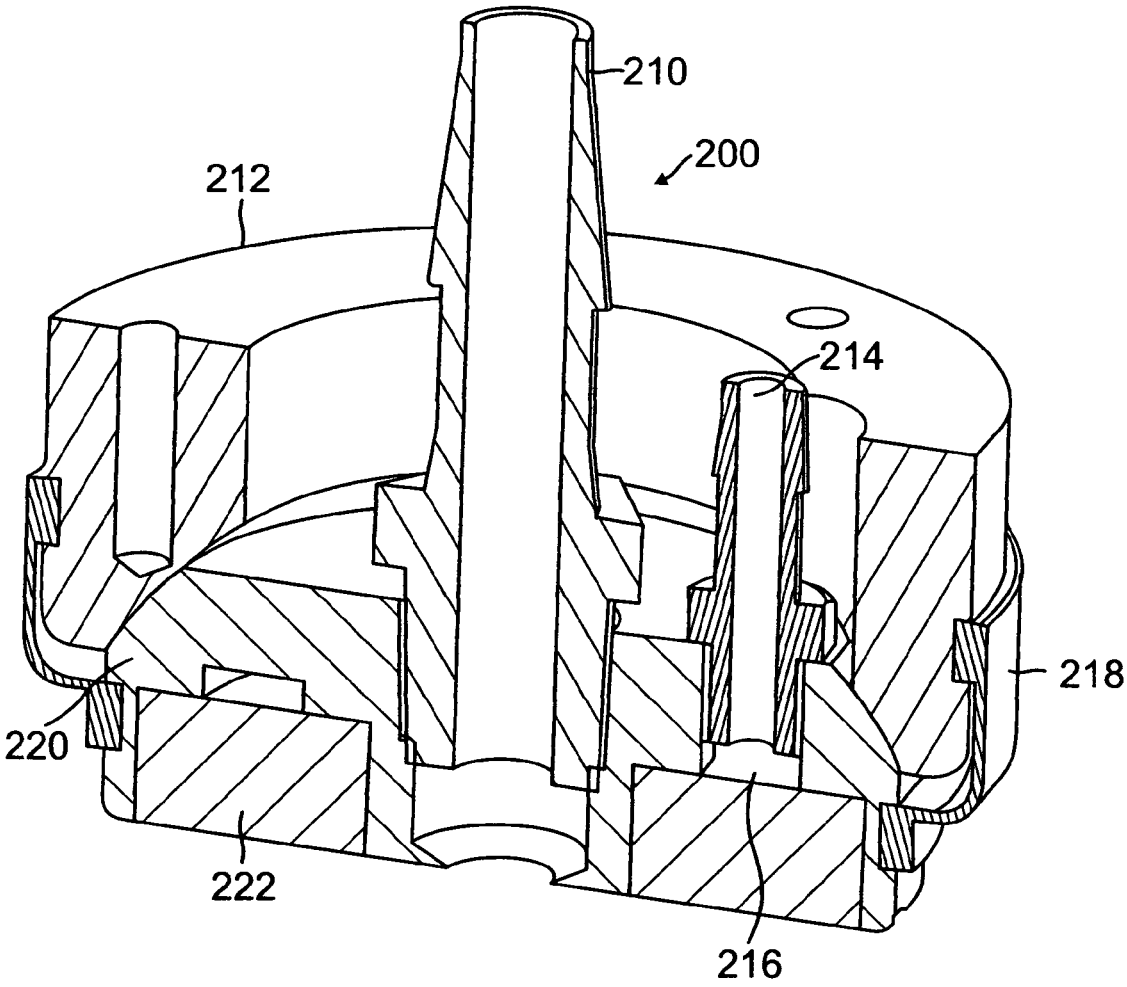
FIG. 3 is a partial perspective, sectional view illustrating the work chuck vacuum cleaner of the present invention.

FIG. 3 shows details of the structure of assembly 200. Specifically, a vacuum source 210 is attached to the hose mount and port 210 within housing 212. Port 214, also mounted within housing 212, is supplied with distilled water or other liquid to enable assembly 200 to hover above the surface 202 of work chuck 204. Channel 216 receives the hovering fluid. A seal 218 is positioned around a portion of the circumference of housing 212 as illustrated and a gimbal block 220 is secured within housing 212 and a porous material 222 is positioned below channel 216.

Figure 4:
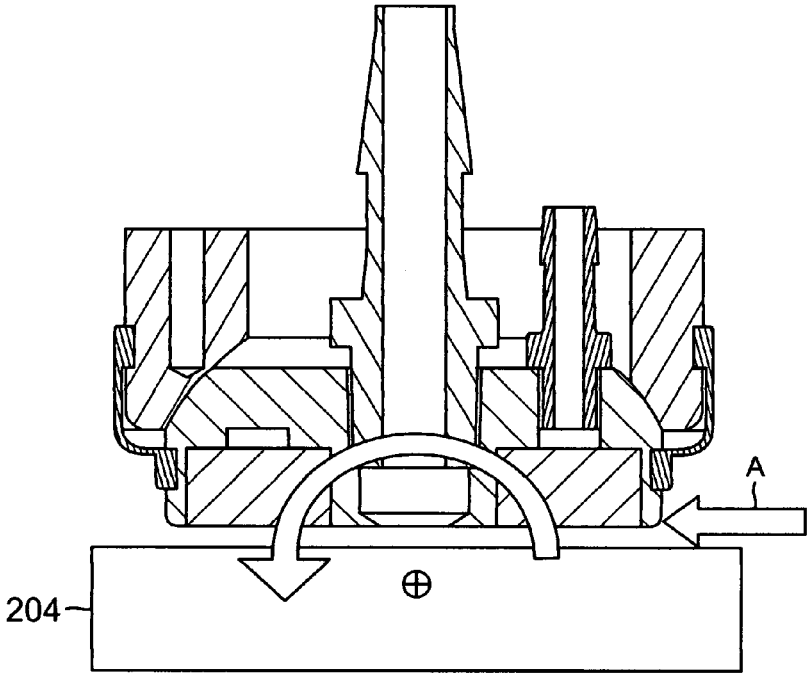
FIG. 4 is a sectional view of the cleaner shown in FIG. 3 illustrating the cleaner positioned above the edge of the work chuck.

Referring to FIG. 4, as work chuck 204 rotates under assembly 200, a side force, illustrated by arrow A, is induced on the assembly. In particular, the side force is generated by the relative motion of the chuck surface under the assembly or by the movement of the indexing table (not shown) that supports the chuck spindle mechanism. Since the projected gimbal point is below the top surface 202 of work chuck 204, the leading edge of assembly 200 will not impact surface 202. Specifically, the projected gimbal mechanism prevents the leading edge of assembly 200 from digging into the top surface of work chuck 204. Since the projected gimbal point is below the surface of the work chuck, a side force (caused by friction between the moving parts) is exerted on assembly 200, the leading edge will rotate upward instead of downward into the surface of the work chuck, allowing for smooth, vibration-free operation of the vacuum cleaner.

Figure 5:
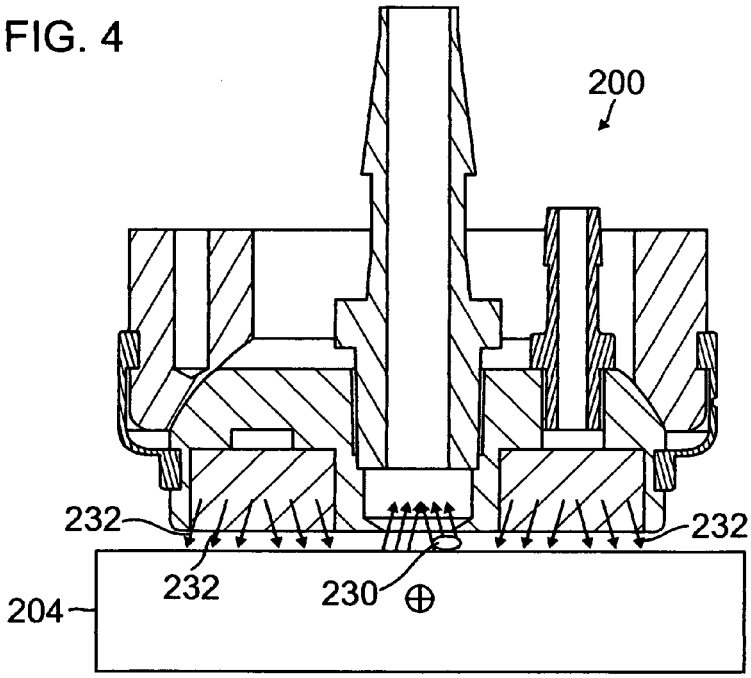
FIG. 5 is a sectional view of the cleaner shown in FIG. 3 illustrating the use of fluid flow to cause the cleaner assembly to hover above the top surface of the work chuck.

Referring to FIG. 5, the basic operation of assembly 200 is illustrated. Particles of debris (represented by a single particle 230) need to be removed from the edge of chuck 204 for the reasons noted hereinabove. Fluid flow is initially introduced into inlet port 214; fluid represented by arrows 232 emitted through porous member 222 impinges upon the surface of the work chuck causing assembly 200 to hover above the surface of chuck 204 (the work chuck back flush could alternatively be utilized to hover assembly 200 above the work chuck surface). At this time, a vacuum flow is introduced to vacuum inlet 210 by the vacuum source used to hold the work piece on the chuck surface or by an independent vacuum source. The vacuum flow pulls the particles from the surface of chuck 204, through vacuum port 210 and hence to a storage container. A movable arm positions assembly 200 above the surface of work chuck 204.

To provide a technique for ensuring that the particles are removed from the chuck surface for collection by the vacuum source, a sonic source (not shown) is placed in the fluid flow supply line, the sonic energy being directed to the chuck surface by the fluid flow itself.

Note that although the cleaning assembly 200 of the present invention is shown positioned adjacent the edge portion 206 of work chuck 204 since the edge accumulates debris, or swarf, generated during the grinding process, the assembly can also be utilized to clean all portions of the chuck surface.

The vacuum source can be manually initiated for most applications. However, if cleaning is required for every work piece, a control signal can be provided from the system control software to actuate the vacuum assembly after every wafer (or every $N^{th}$ wafer) is ground.

The operative cycle of assembly 200 is as follows:

After the wafer is removed from the top surface of the work chuck 204, the work chuck blow-off (air) and back flush (DI water) will be turned on to purge the majority of the particulates that were sucked into the porous work chuck material during the grinding cycle. During this process, the work chuck 204 will spin to push the particles off the edge of the work chuck. Now the majority of the particulates have been removed, the vacuum assembly will be actuated and placed on the work chuck. The majority of particles will be stuck where the perimeter of the wafer made contact with the porous section of the work chuck. Vacuum assembly 200, the preferred embodiment, starts near the center of work chuck 204 and moves radially outward, as the chuck slowly rotates, until it reaches the location where the majority of the undesirable particulates are stuck. The vacuum assembly stays in this location as the work chuck rotates slowly. After the user defined vacuum time setting has been reached, the vacuum assembly will lift and rotate back to the home position. Note that vacuum assembly 200 never touches the surface of work chuck 204; there is always a layer of water present to cause the assembly to hover above the surface of the work chuck, the water being supplied either from assembly 200 or through the work chuck pores from below the porous chuck.

Note that a movable arm or indexer positions assembly 200 above the surface of work chuck 204 and moves the assembly across the work chuck surface in the manner described hereinabove. A microcontroller is provided to move the arm or indexer in the desired sequence.

Figure 6:
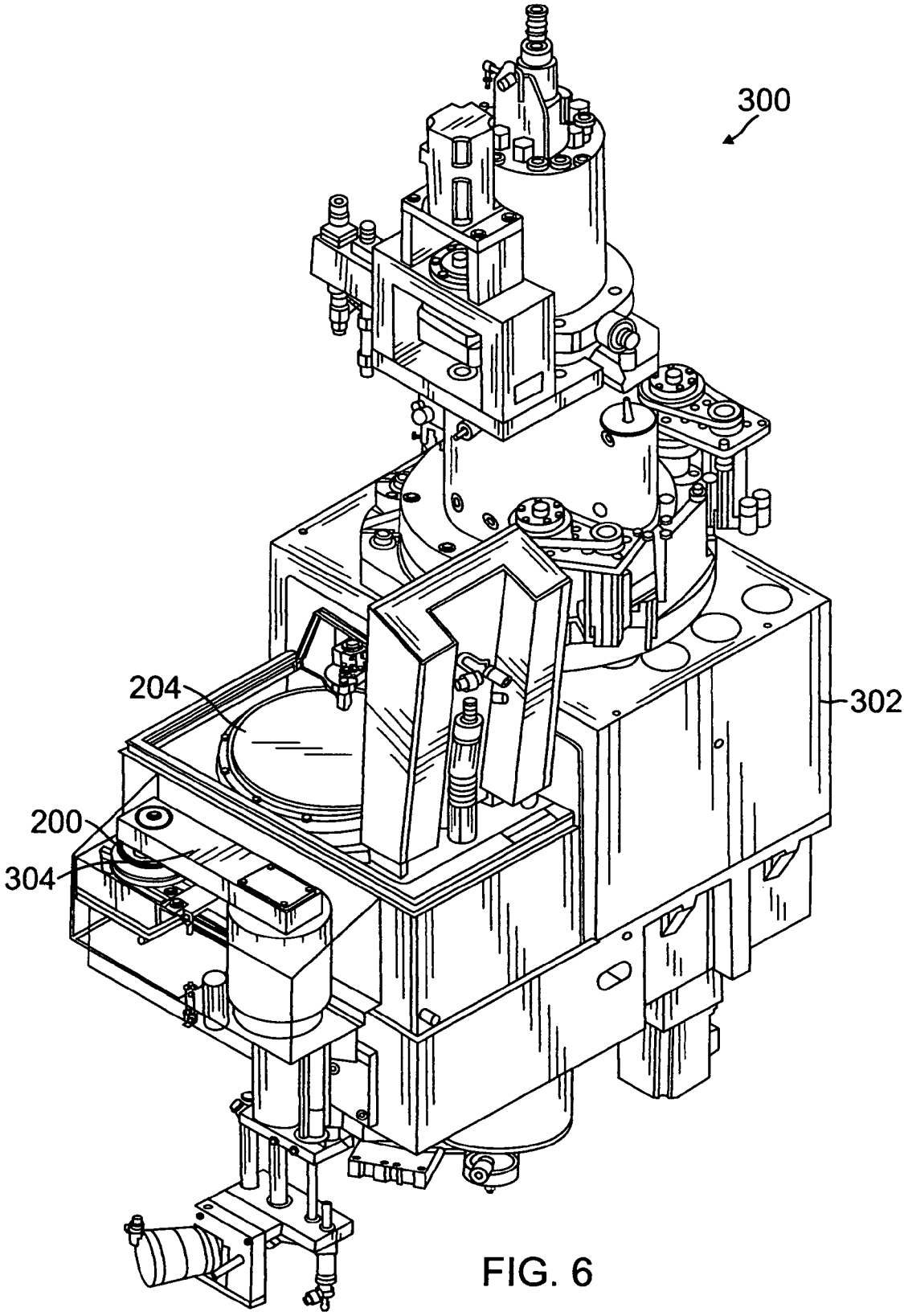
FIG. 6 is a perspective view of another embodiment of the grind apparatus using an arm to move the vacuum assembly.

FIG. 6 illustrates another grind engine (assembly) 300 in which the vacuum cleaning assembly 200 of the present inventor can be utilized (illustrated is the recently introduced Model 7AH grind engine manufactured by Strasbaugh, San Luis Obispo, Calif.). The components of particular interest with the respect to the invention illustrated are the porous grind chuck 204, vacuum assembly 200, base casting 302 and arm 304. A controller (not shown) is utilized to position arm 304 adjacent the work chuck 204.

Figure 7:
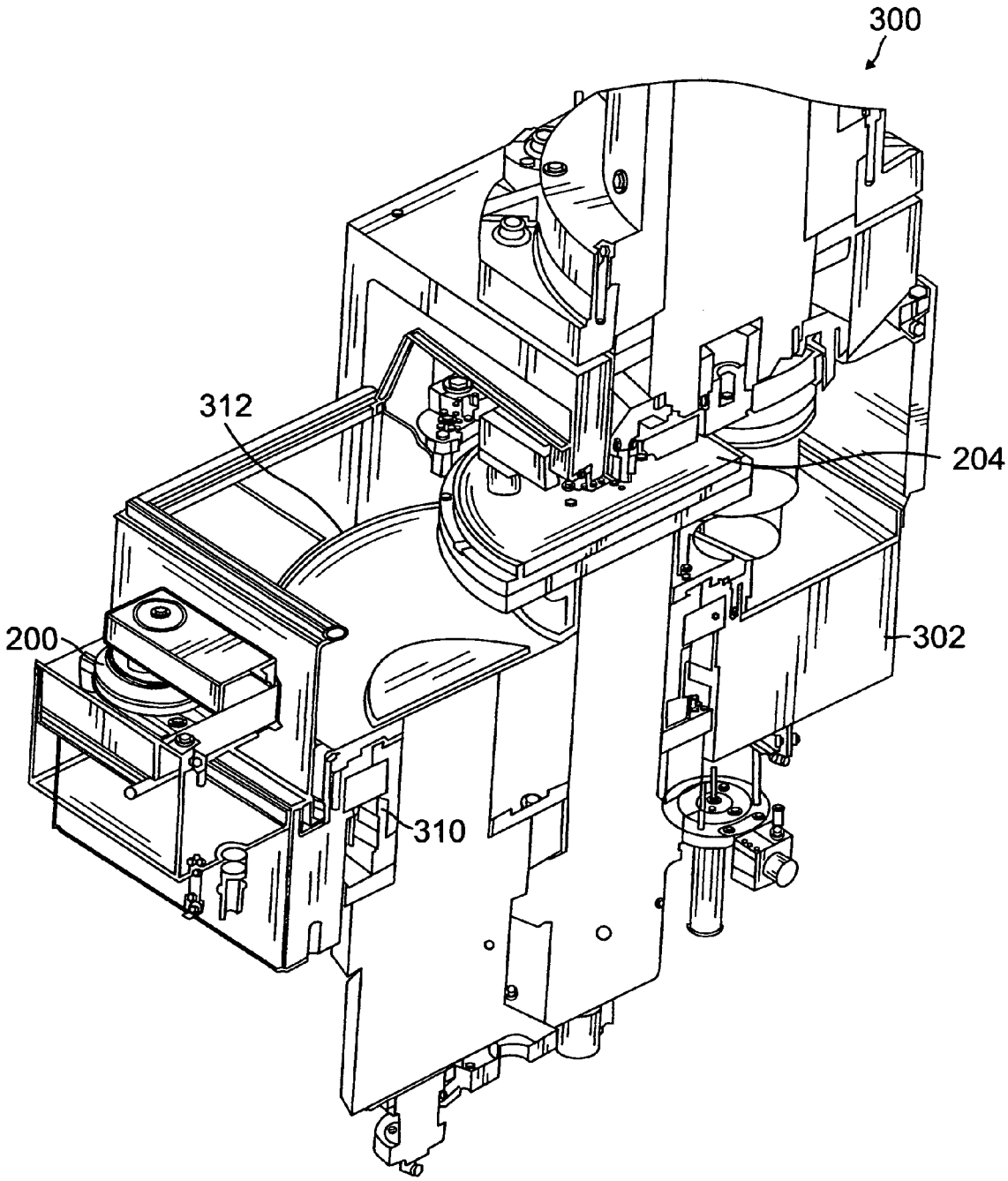
FIG. 7 is a more detailed view of the grind engine of FIG. 6 modified to use an arm to move the vacuum assembly.

FIG. 7 is a different view of grind engine 300 and illustrates an alternate version of the vacuum assembly positioner. In particular, grind engine 300 is modified to incorporate a bearing 310 and rotary indexer 312. Bearing 310 is seated in base casting 302 and rotary indexer 312 is seated in bearing 310.

The use of a controlled indexer to position a mechanical component is well known in the prior art and is not described herein in detail since it is not considered part of the present invention. Once the arm 304 has positioned cleaner 200 on chuck 204, the indexer motion can be used to move cleaner assembly 200 across the top surface of chuck 204.

Although the cleaning process described hereinabove is preferably performed after the wafer grinding process, the cleaning process may be modified so that it occurs during the grinding process. In addition, for thin wafers, a second vacuum source may be added below the work chuck to ensure that the wafer edge is firmly held down in order to avoid lifting of the edge, thus allowing swarf to be pulled into the vacuum assembly.

The process described hereinabove maintains the surface of the work chuck clean from grind swarf particles to avoid non-uniform thickness of the wafers and wafer star cracks in wafers generated from the vertical grinding force on the wafer being ground.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A grind apparatus for grinding a surface of a workpiece comprising:

a grind wheel;

a porous work chuck having top and bottom surfaces;

means for rotating said work chuck and said grind wheel;

a first vacuum source positioned adjacent the bottom surface of said work chuck for holding said workpiece in position on said bottom surface of said work chuck;

a vacuum assembly positioned adjacent to said bottom surface of said work chuck;

means for introducing a fluid flow to the grind apparatus whereby said vacuum assembly is caused to hover above said top surface of said work chuck;

means for moving said vacuum assembly across the top surface of said work chuck; and means for energizing said vacuum assembly whereby particles on the top surface of said work chuck remaining after grinding of said workpiece are substantially removed.

2. The apparatus of claim 1 wherein said vacuum assembly is moved by said moving means in a radial direction outward from the center home position of said work chuck.

3. The apparatus of claim 2 wherein said vacuum assembly is moved by said moving means to the perimeter of said work chuck.

4. The apparatus of claim 3 wherein said work chuck is rotated by said rotating means.

5. The apparatus of claim 4 wherein said vacuum assembly is moved to the center home position of said work chuck.

6. A grind apparatus for grinding the surface of a work piece comprising:

a work chuck having a first surface for supporting said workpiece;

a stationary housing;

a vacuum source positioned within said stationary housing; and a fluid port positioned within said stationary housing for receiving fluid, fluid introduced into said port causing said housing to hover above said first surface of said work chuck whereby the surface or said work chuck is cleaned after said workpiece is ground.

7. The apparatus of claim 6 wherein said vacuum assembly house is caused to hover above the top surface of the work chuck by activating the work chuck back flush fluid after completion of an active grinding process with or without the introduction of fluid into said housing port.

8. The apparatus of claim 6 wherein the projected gimbal point of the vacuum assembly is below the bottom surface of the work chuck.

9. A method for cleaning particles from the surface of a circular cylinder shaped and rotatable work chuck used in a grind apparatus comprising the steps of:

providing a work chuck having first and second surfaces, said work chuck being operable in conjunction with said grind apparatus;

positioning a vacuum source operatively associated with said grind apparatus adjacent said first surface of said work chuck;

activating said vacuum source whereby said particles are substantially removed from the first surface of said work chuck; and providing a fluid source operatively associated with said work chuck, said fluid source being activated causing said vacuum source to hover above said first surface of said work chuck.

* * * * *